US009420874B2

(12) United States Patent
Castex et al.

(10) Patent No.: US 9,420,874 B2
(45) Date of Patent: Aug. 23, 2016

(54) APPLICATOR FOR APPLYING A COMPOSITION TO THE EYELASHES AND INCLUDING SUPPORTS FASTENED TO A STEM

(75) Inventors: Nicolas Castex, Asnieres sur Seine (FR); Yoon Hoi Kim, Leonia, NJ (US)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 144 days.

(21) Appl. No.: 14/005,396

(22) PCT Filed: Mar. 14, 2012

(86) PCT No.: PCT/FR2012/050525

§ 371 (c)(1),
(2), (4) Date: Dec. 19, 2013

(87) PCT Pub. No.: WO2012/123675

PCT Pub. Date: Sep. 20, 2012

(65) Prior Publication Data

US 2014/0105667 A1 Apr. 17, 2014

(30) Foreign Application Priority Data

Mar. 15, 2011 (FR) ..... 11 52084

(51) Int. Cl.

| | |
|---|---|
| ***A46B 11/00*** | (2006.01) |
| ***A46B 9/02*** | (2006.01) |
| ***A46D 1/00*** | (2006.01) |

(Continued)

(52) U.S. Cl.

CPC ..... *A46B 9/021* (2013.01); *A45D 40/265* (2013.01); *A46D 1/02* (2013.01); *A46B 13/003* (2013.01); *A46B 13/006* (2013.01); *A46B 2200/1053* (2013.01)

(58) Field of Classification Search

CPC ..... A46B 2200/1053; A46B 2200/106
USPC ..... 401/126, 129
See application file for complete search history.

(56) References Cited

U.S. PATENT DOCUMENTS

| | | | | |
|---|---|---|---|---|
| 5,107,870 | A | 4/1992 | Beck et al. | |
| 8,091,562 | B2 * | 1/2012 | Manici et al. | 132/218 |
| 8,919,351 | B1 * | 12/2014 | Wang | 132/218 |

(Continued)

FOREIGN PATENT DOCUMENTS

| | | | |
|---|---|---|---|
| CN | 1043253 | A | 6/1990 |
| CN | 1331041 | A | 1/2002 |

(Continued)

OTHER PUBLICATIONS

Jul. 3, 2012 Search Report issued in International Patent Application No. PCT/FR2012/050525 (with translation).

(Continued)

*Primary Examiner* — Jennifer C Chiang
(74) *Attorney, Agent, or Firm* — Harness, Dickey & Pierce, P.L.C.

(57) ABSTRACT

The applicator for applying a composition to the eyelashes includes a stem and a brush including at least two independent supports following one after the other along an axis of the stem, each support carrying projections that present respective bases. At least one group of at least four consecutive bases of each support form a regular succession about the axis, two of the bases of the group constituting two ends that terminate the succession.

16 Claims, 6 Drawing Sheets

(51) Int. Cl.
*A45D 40/26* (2006.01)
*A46B 13/00* (2006.01)

(56) References Cited

U.S. PATENT DOCUMENTS

| | | | | |
|---|---|---|---|---|
| 2002/0014254 | A1 | 2/2002 | Gueret | |
| 2007/0062552 | A1* | 3/2007 | De Brouwer | A45D 34/045 132/218 |
| 2008/0023020 | A1 | 1/2008 | Gueret | |
| 2009/0276973 | A1 | 11/2009 | Bouix et al. | |
| 2010/0037911 | A1* | 2/2010 | Kim | A45D 40/262 132/218 |

FOREIGN PATENT DOCUMENTS

| | | | |
|---|---|---|---|
| CN | 102014691 | A | 4/2011 |
| EP | 2 196 106 | A1 | 6/2010 |
| FR | 2 906 692 | A1 | 4/2008 |
| FR | 2955017 | A1 | 7/2011 |
| JP | 2009 242 704 | A | 10/2009 |
| RU | 2380015 | C2 | 1/2010 |

OTHER PUBLICATIONS

Jul. 3, 2012 Written Opinion issued in International Patent Application No. PCT/FR2012/050525 (with translation).
Nov. 3, 2014 Office Action issued in Chinese Patent Application No. 201280012871.4.
Nov. 3, 2014 Search Report issued in Chinese Patent Application No. 201280012871.4.
Chinese Office Action mailed on Jul. 13, 2015, and English translation thereof.
Russian Office Action to corresponding Russian Application No. 2013140351/12(061350) mailed on Feb. 10, 2016, and English translation thereof.
Japanese Office Action mailed on Aug. 28, 2015, and English translation thereof.

* cited by examiner

APPLICATOR FOR APPLYING A COMPOSITION TO THE EYELASHES AND INCLUDING SUPPORTS FASTENED TO A STEM

The invention relates to applicators for applying a composition to the eyelashes, in particular mascara.

BACKGROUND OF THE INVENTION

It is known to make the brush of a mascara applicator by means of supports that are stacked one after another along the stem of the applicator, as described in application FR 2 906 692 for example. Each support carries one or more projections and, by shape co-operation between the support and the stem, may be placed in different angular positions about the axis of said stem.

OBJECTS AND SUMMARY OF THE INVENTION

An object of the invention is to provide brushes of a novel type, in particular with a view to offering more design possibilities and to improving their properties.

To this end, the invention provides an applicator for applying a composition to the eyelashes, which applicator comprises a stem and a brush including at least two independent supports following one after the other along an axis of the stem, each support carrying projections that present respective bases, at least one group of at least four consecutive bases of each support forming a regular succession about the axis, two of the bases of the group constituting two ends that terminate the succession.

Thus, by selecting the arrangement of the successive supports, it is possible to make brushes of various configurations. In particular, it is possible: to form zones on the brush that have a higher density of projections than have other zones; to select the position of each zone; or to select their density difference. The lower density zones make it possible to collect a large amount of mascara, thereby forming reserves for application purposes. In contrast, the higher density zones promote coating, combing, and separation of the eyelashes, while avoiding the appearance of clumps.

Furthermore, the bases that constitute the ends create a discontinuity in the succession. While the successive supports are being positioned, this discontinuity makes it possible, for a given number of supports, to increase the number of zones having higher densities and lower densities of projections, or to increase the relative density of the higher density zones. An additional parameter is thus available for designing the brush, which parameter makes it possible to multiply the number of brush configurations that can be envisaged, and to obtain brushes that offer properties that are improved, in particular in connection with the composition that they are used to apply, in particular so as to promote a good separation or combing effect, or so as to promote the coating of each eyelash so as to give it volume. By way of example, the succession may be such that the bases define a curve, in particular of a conventional and recognizable type, the above-mentioned ends forming a discontinuity or a break in the curve.

Preferably, in the or each succession, at least two of the bases are situated at respective positions along the axis that are different from each other.

Distributed in this way, the bases promote separation and combing of the eyelashes, in particular when the user turns the brush about its axis while applying mascara.

In an embodiment, in at least one of the groups, the bases form a helix.

Such a curve distributes the bases regularly in different planes that are perpendicular to the axis of the stem so as to further increase the combing and separating effect and thereby reduce the risks of clumps appearing.

In another embodiment, in at least one of the groups, the bases form a sine wave.

This embodiment makes it possible both to have good distribution of the bases in different planes that are perpendicular to the axis, and to generate higher density zones at the extremums of the sine wave.

In an embodiment, the two supports or at least two contiguous supports among the supports are images of each other resulting from a shift in translation parallel to the axis.

In another embodiment, the two supports or at least two contiguous supports among the supports are images of each other resulting from the combination of a shift in translation parallel to the axis and a rotation about the axis through an angle that is not a multiple of 360°.

Provision may be made for rotation to take place through an angle that is less than 180° and in the same direction as the or each helix.

In contrast, provision may be made for rotation to take place through an angle that is less than 180° and in a direction that is different from the direction of the or each helix.

In an embodiment, the two supports or at least two contiguous supports among the supports are images of each other resulting from a rotation about an axis that is perpendicular to the axis of the stem.

Advantageously, in each support or at least one of the supports, the number of groups forming a succession is greater than or equal to two, the groups forming helices for example.

As a function of the way the successions are configured, each of these characteristics makes it possible to obtain a greater or smaller number of higher density zones, and to give said higher density zones greater or smaller densities. However, the various brush configurations are obtained by means of a single model of support, at the very least for the supports that are isomorphic images of one another.

Preferably, each projection of the or each group extends in a plane that is perpendicular to the axis.

Such an arrangement promotes combing and mutual separation of the eyelashes in use.

Preferably, each support is configured so that it does not present any plane of symmetry parallel to the axis, indeed presents no plane of symmetry.

Advantageously, each support is configured so that there does not exist any rotation through an angle that is not a multiple of 360° for which the support is an image of itself resulting from this rotation.

Thus, on turning the support about the axis of the stem, the same arrangement of the projections is not found before the support has been turned through one complete revolution. Each orientation of the support relative to the stem is thus associated with a configuration of projections that is different and that is specific to that orientation. Consequently, an additional degree of freedom is obtained for use in designing the brush.

Preferably, each support is configured so that there does not exist any rotation through an angle that is not a multiple of 360° for which the support is an image of itself resulting from this rotation.

Advantageously, the supports are mounted on an arm of the stem, and the arm and each support are arranged so as to make it possible to hold the support stationary on the arm in a position selected from among at least two different predetermined relative angular positions about the axis, the number of projections on the support not being divisible by the number of different positions.

This characteristic is one of the ways of implementing the preceding characteristic.

Advantageously, on each support, the projections are at least four in number, at least two of the projections being identical to each other and different from at least two others of the projections.

Thus, on a single support, certain projections promote the accumulation of composition, while others promote combing and separation of the eyelashes.

On each support, provision may be made for at least two of the projections to be made out of different respective materials, in particular presenting different hardnesses.

The projections made out of hard material have greater separating ability than the others. The projections made out of softer material tend to become more loaded with composition. These two types of function are thus obtained within a single support. By varying the arrangement of successive supports, it is also possible to select the configuration of the zones for holding composition, and the zones for separating the eyelashes.

The invention also provides an assembly for applying a composition to the eyelashes, which assembly comprises a composition reservoir and an applicator of the invention.

BRIEF DESCRIPTION OF DRAWINGS

Other characteristics and advantages of the invention appear further in the following description of several embodiments, given by way of non-limiting example, and with reference to the accompanying drawings, in which.

MORE DETAILED DESCRIPTION

First Embodiment

Figure 1:
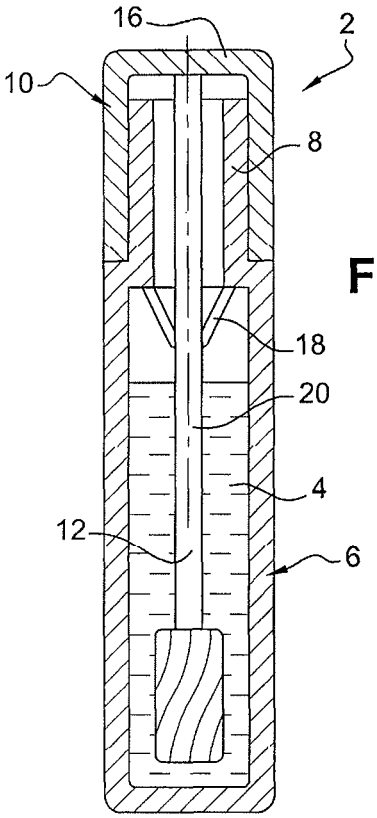
FIG. 1 is an axial-section view of an assembly in an embodiment of the invention.
Figure 2:
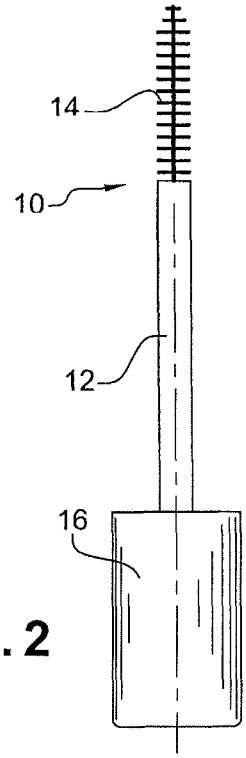
FIG. 2 is an elevation view of the applicator of the FIG. 1 assembly.

FIG. 1 shows an assembly 2 for applying a composition 4 to the eyelashes or even the eyebrows. In this embodiment, the composition 4 is mascara. The assembly 2 includes a reservoir 6 containing the composition, said reservoir being of shape that is generally cylindrical and that is extended at its the top portion by a neck 8 that presents a greatest diameter that is smaller than the greatest diameter of the reservoir. The assembly 2 includes an applicator 10, also shown in FIG. 2, that comprises a stem 12 presenting a brush 14 at one end, and a grip member 16 at its other end, which grip member 16 also serves as a cap for the reservoir 6 when said member is screw-fastened on the neck of the reservoir, as shown in FIG. 1. In this position, the stem 12 passes through the neck 8 and the brush dips into the composition 4 contained in the reservoir. At its bottom end, the neck carries a wiper 18, e.g. made of flexible material, having the function of removing excess composition from the brush while the applicator is being extracted from the reservoir.

The assembly presents a longitudinal axis 20 that generally forms an axis of circular symmetry for the assembly in general and of the applicator in particular, specifically of its stem 12 and of its brush 14.

Figure 3:
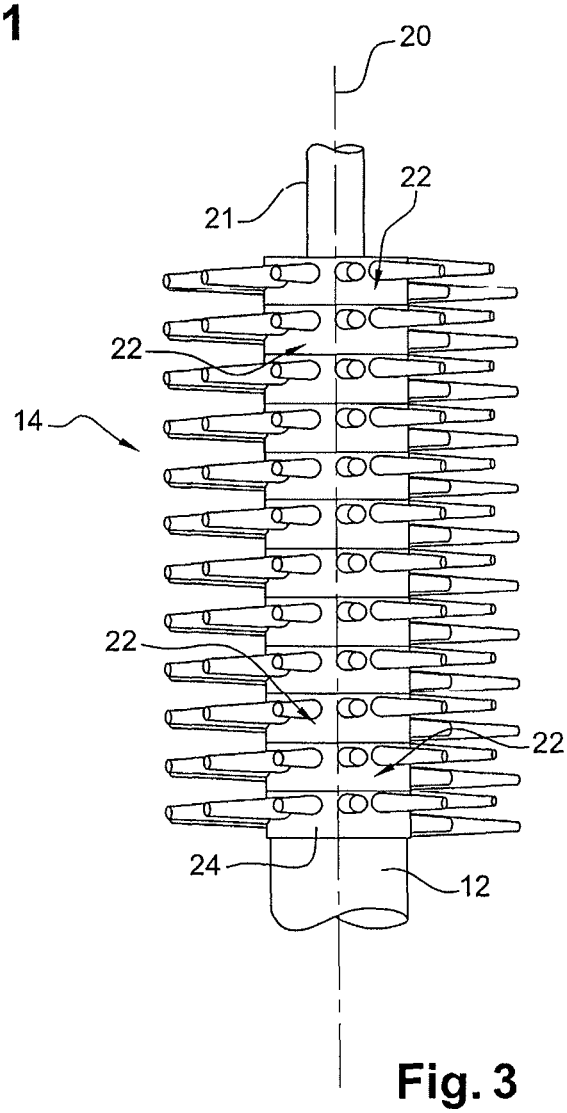
FIG. 3 is a fragmentary view of the brush of the FIG. 2 applicator.

The brush 14 is shown in greater detail in FIG. 3. The stem 12 carries an extension in the form of an arm 21 that is on the same axis as the stem but that is of diameter that is smaller so that the stem forms a shoulder at the beginning of the arm. The stem and the arm may be formed as a single part, or as two separate parts that are engaged one in the other.

Over at least a major portion of its length, the brush is formed by annular supports 22 that are stacked on the arm 21, being slid one after the other along the direction of the axis 20. Successive supports are in contact with one another via their axial end faces, each support being contiguous to its two neighbors. In this configuration, the supports are identical to one another. In the present embodiment, each support comprises a core 24, specifically in the shape of a disk, thus presenting a top end face 26, a bottom end face 28, and a cylindrical side face 30 having a circular section in a plane that is perpendicular to the axis 20.

Each support 24 is coaxial about the axis 20. An orifice 32 of axis 20 passes through each support, said orifice presenting, in a plane that is perpendicular to said axis, a profile that is not circular, specifically a profile that is square. The arm 21 presents a profile that is complementary to the profile of the orifice 32, i.e. likewise square. By means of the complementary shapes of the arm and of the orifice 32, the support 22 may be slid over the arm to occupy any position selected from the four different predetermined angular positions of the support about the axis 20 relative to the arm, the positions being separated from one another by one fourth of a turn. The stack of supports bears axially against the shoulder formed at the junction of the stem 12 and of the arm 21 that extends it. Other constructions are possible.

Each support 22 includes projections that, in this embodiment, form respective fibers that are specifically of two types and that are referred to respectively as "bristles" 34 and as "teeth" 36. In the present embodiment, each support 22 includes thirteen fibers comprising ten identical bristles 34 and three identical teeth 36. In this embodiment, the bristles 34 and the teeth 36 have the same length. Furthermore, in this embodiment, each fiber extends along a direction that is radial relative to the axis 20, and lies in a plane that is perpendicular to said axis. In this and the following embodiments, the bristles 34 are more numerous and finer than the teeth 36.

Each of the bristles 34 presents a main trunk 32 of shape that is generally conical or frustoconical, the diameter of the cone tapering on going away from the support 24. Each bristle 34 further includes one or more branches 36, specifically two branches on either side of the trunk, and extending from a zone of the trunk 32 that is spaced apart from the core 24, each branch extending along a direction that tends to take it away from the core 24 and towards two adjacent fibers. In this embodiment, the two branches extend so that the branches and the trunk lie in a single plane that is perpendicular to the axis 20. Such a projecting shape is sometimes called a snowflake shape.

In this configuration, the teeth 36 are constituted by respective rectilinear cylindrical trunks of section that is circular in a plane that is perpendicular to its longitudinal direction, and the trunks having free ends that are rounded, each having the shape of a portion of a sphere.

Figure 5:
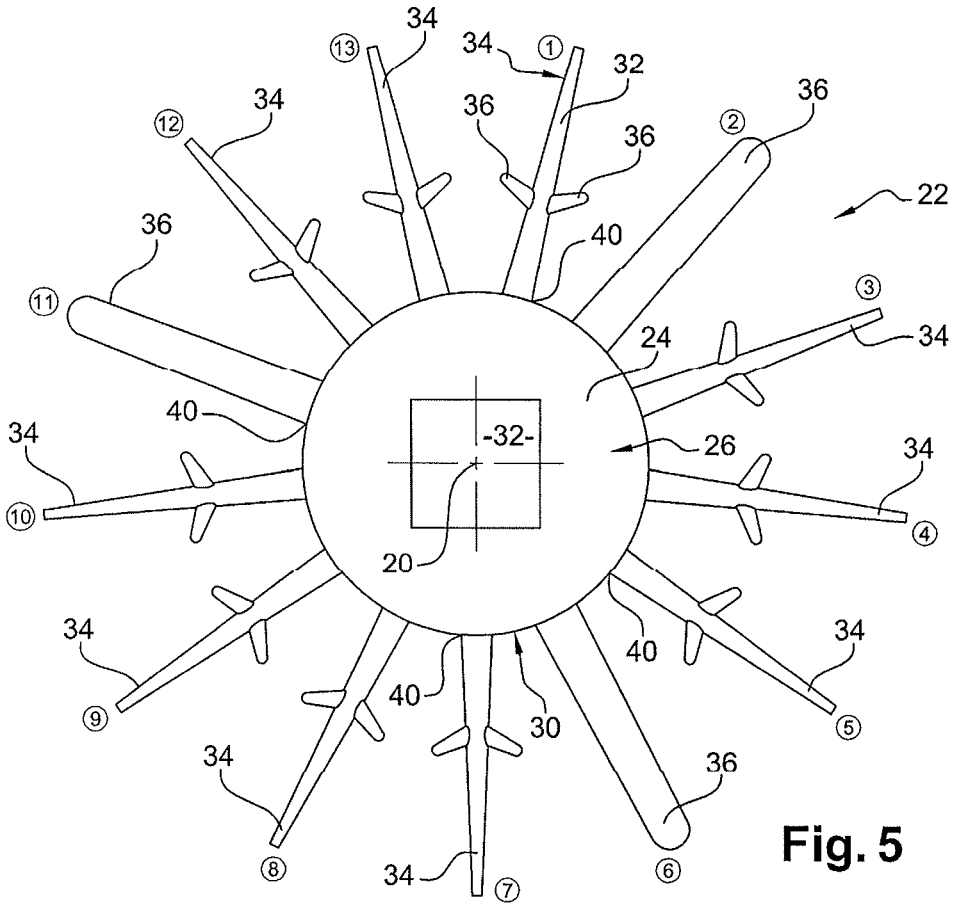

In the present embodiment, the fibers 34 and 36 are distributed regularly about the axis 20 when the support is observed axially, as in FIG. 5. As a result, when considering only the axes of the fibers in a plan view, they are equidistant from one another about the axis 20 from which they extend radially.

In this configuration, the teeth 36 are not contiguous to one another, and are separated from one another by a plurality of bristles 34, specifically at least three bristles. In this embodiment, the position of the fibers are indicated as a clock face, and, starting from 12 o'clock, they are numbered in the clockwise direction from 1 to 13. In FIG. 5, the bristles 34 occupy locations that are situated at 13°, 70°, 98°, 126°, 182°, 210°, 236°, 262°, 317°, and 345° respectively. The teeth 36 occupy positions that are situated at 40°, 153°, and 290°.

Figure 4:
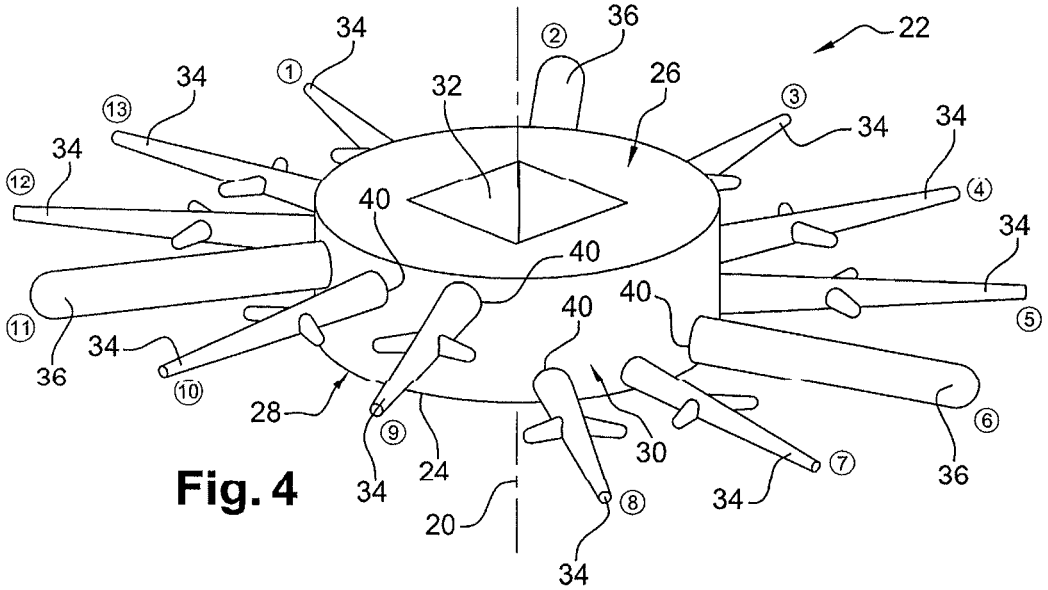
FIGS. 4 and 5 are perspective and plan views respectively of one of the supports of the FIG. 3 brush.
Figure 6:
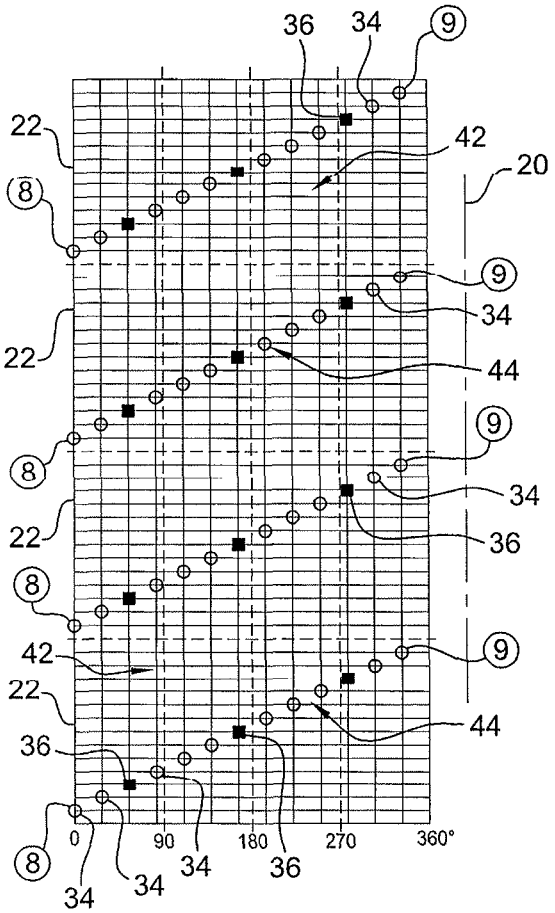
FIG. 6 is a developed view of a segment of the core of the FIG. 3 brush showing the layout of the bases of the projections.

The positioning of the fibers in plan view, as in FIG. 5, is described in detail above. Their positioning along the axis 20, as shown in FIGS. 3, 4, and 6, is described below. The end of each fiber that is connected to the core 24 is referred to as its base 40. FIG. 6 is a cylindrical projection or developed view of the cores of a segment of the brush formed by four successive supports 22. The bases of the bristles 34 are shown by white circles, and the bases of the teeth 36 by solid black squares. In this figure, the axis 20 thus corresponds to the vertical direction, while the horizontal direction corresponds to the circumference of each core 24.

In FIG. 6 as in the following figures, a grid pattern is shown for each support 22, which pattern includes thirteen horizontal lines, one per fiber, ignoring the end lines that correspond to the faces of the core 24. The pattern also includes thirteen vertical lines, one per fiber, ignoring the rightmost line that in fact coincides with the leftmost line.

In this embodiment, all of the fibers of the support are arranged so that the bases 40 form a regular succession about the axis 20. Specifically, the succession is a helical succession that, once developed, as in FIG. 6, takes the form of a succession of straight lines that slope relative to the vertical and horizontal directions. All of the fibers 34, 36 of the support 22 serve to define this helix. As a result, on each support, the fibers extend in respective planes that are perpendicular to the axis and that are all different from one another. In particular, each vertical or horizontal line of the grid pattern intercepts a single fiber.

A configuration is thus obtained such that, when a support 22 is seen in plan view as in FIG. 5, for example, it does not present any plane or axis of symmetry, e.g. that is parallel to the axis 20 and in particular that is radial relative thereto. Furthermore, there is no angle of rotation, e.g. about the axis 20, other than a multiple of 360° for which the support 22 is an image of itself resulting from said rotation. Furthermore, the number of fibers, thirteen in this embodiment, is not divisible by the number of positions that the support can occupy on the arm about the axis, i.e. four positions in this embodiment. In this respect, it is useful to select a number of fibers that is a prime number, as in this configuration.

The bases of the bristles 8 and 9 constitute the ends of the helix in FIG. 4, and of the straight line in FIG. 6. These are the bristles that are closest to the respective axial end faces of the core 24. The helix and the succession terminate at each of these bases. The succession thus presents a break or discontinuity when passing directly from one of the two bristles under consideration to the other. These two bristles extend towards the reader in FIG. 4.

Furthermore, in this embodiment, the successive supports 22 of the brush occupy corresponding positions along the axis 20. More precisely, each support 22 is the isomorphic image of its immediate neighbor resulting from a shift in translation along the axis 20. Furthermore, the helices of the supports 22 extend continuously one after the other so as to form only one helix that extends over the entire length of the brush. The vertical lines of the grid patterns are in alignment with one another.

The bottom ends of the helices, the bristles numbered 8, are thus in alignment parallel to the axis 20. The same applies to their top ends 9. This can be seen in particular in FIG. 6. More generally, in this embodiment, each base of the support 22 is in alignment with all of the bases of the other supports that correspond (i.e. that have the same numbers), so that on the brush segment formed by the supports, rows are formed that are parallel to the axis 20 and that have the same numbers of fibers. It is thus possible to distinguish between rows formed entirely of bristles 34, and rows formed entirely of teeth 36. Within each row, the fibers are regularly spaced apart from one another.

In this embodiment, the zones 44 that have the higher densities of fibers are formed by the helical successions of each support 22, while the zones that have the lower densities are formed by the spaces 42 formed between the successions. The higher density zones are thus packed relatively little, and the lower density zones occupy a relatively large area on the brush.

As in this embodiment, provision may be made for an end segment of the brush to be formed other than by a succession of supports 22, e.g. by means of an endpiece carrying bristles, which endpiece is made as a single part by injection-molding, presenting a diameter that tapers towards the free end of the brush, and that is fitted on the arm 21.

Second Embodiment

Figure 7:
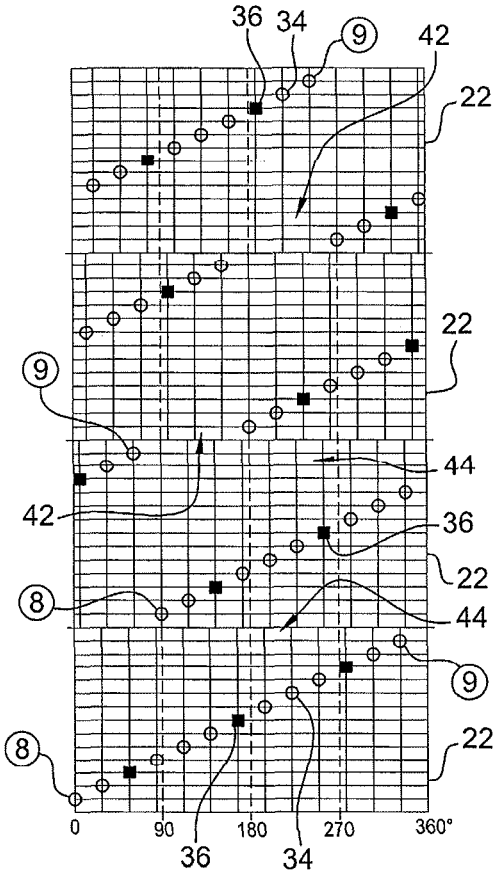
FIGS. 7 to 13 are views similar to FIG. 6 showing brushes in other embodiments, FIG. 12 being associated by a diagram showing the positioning of the successive supports about the axis.

A second embodiment of the assembly of the invention is shown in FIG. 7. It differs from the above embodiment only by the arrangement of the supports 22 relative to one another, the supports being identical to the supports of the first embodiment. In this second embodiment, the supports 22 are arranged so that each support is offset by one fourth of a turn relative to support that precedes it in the succession. In other words, each support is an isomorphic image of the preceding support resulting from a shift in translation along the direction of the axis 20 over a length that is equal to the length of the support, together with a rotation about the axis, specifically through one fourth of a turn. The direction and the angle of rotation are the same over the entire brush, so that the brush presents periodicity that is equal to four supports 22 along its axis. Furthermore, the direction of rotation is the same as the direction of the helix of each support.

In contrast to the above embodiment, the brush obtained in this way is not constituted by fiber rows that are parallel to the axis and that have the same numbers of fibers. None of the fibers of one of the supports 22 is in alignment with any of the fibers of the next support in the succession. The same also applies for the vertical lines of their grid patterns. In addition, the positions situated at 90°, 180°, 270°, and 360° about the axis of the brush are marked with dashed straight lines.

In particular, as can be seen in FIG. 7, the top end of the helix of one of the supports 22 is not followed immediately by the bottom end of the helix of the next support, thereby creating a space in the horizontal direction. Clear zones 42 that are suitable for forming reserves of composition are thus created at these locations. In contrast, zones 44 that have relatively high densities of fibers are created between the successive helices along the axial direction.

With a brush in accordance with the embodiment of FIG. 7, the result obtained in terms of makeup effect depends on the type of brush movement performed by the user to a greater extent than with the embodiment of FIG. 6.

Third Embodiment

Figure 8:
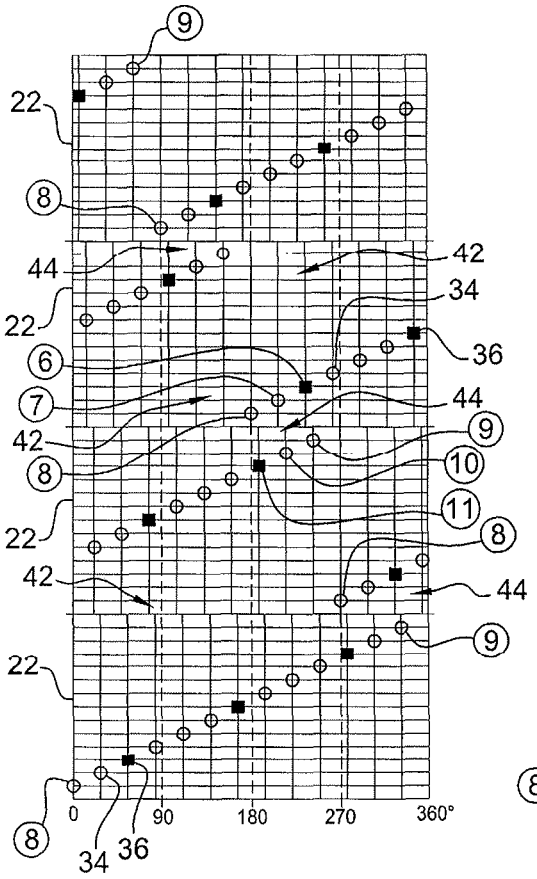

FIG. 8 shows a third embodiment that differs from the above embodiment only by the fact that the direction of rotation used for offsetting the supports 22 relative to one another about the axis 20 is opposite to the direction of the helix defined by the bases of each support, the angle of rotation, 90°, being unchanged. As a result, the top end 9 of the helix of each support extends forwards, in the direction of rotation of the helix, relative to the bottom end of the helix of the support situated immediately above. In this embodiment, it should be observed that the situation would be the same if the direction of rotation of the preceding embodiment were conserved, while turning through an angle of rotation of 270°.

It can be seen in FIG. 8 in particular that the subset of the three fibers numbered 11, 10, and 9 at the top end of the helix is very close in the axial direction of said helix to the three fibers numbered 8, 7, and 6 at the bottom end of the helix of the next support.

This thus forms a group of six fibers that are relatively close together, having bases that form a parallelogram. This forms a zone 44 that has a particularly high density of fibers or is packed full of fibers, and that is suitable for providing a good separating and combing effect for the eyelashes. It can be seen that the four supports 22 in FIG. 8 form a total of three zones 44 of this type. In this configuration, the brush nevertheless also includes large zones 42 that are free of fibers, thus forming reserves of composition.

Fourth Embodiment

Figure 9:
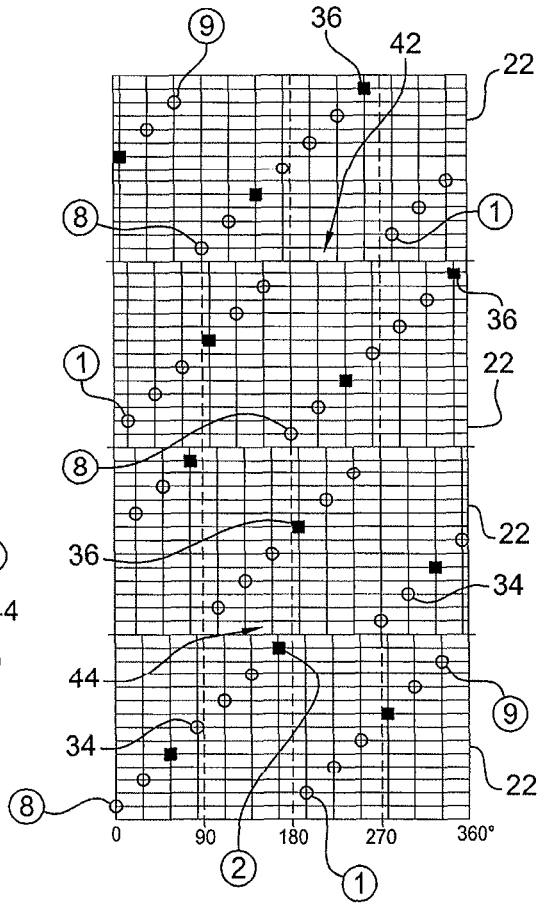

In the fourth embodiment of FIG. 9, the supports 22 are different from the supports of the above embodiments. This time, the bases 40 define not one, but two regular successions about the axis, each of the successions presenting two ends that are formed by two of the bases. Each end terminates the corresponding succession. In this configuration, each of the two successions has a helical shape, the two helices having the same pitch and the same direction of rotation. Furthermore, each base forms part of only one of the successions. In this embodiment, in plan view, the support 22 presents a configuration that is identical to the configuration of the support 22 in FIG. 5, described with reference to the first embodiment. Seven consecutive fibers about the axis form the first succession, and the other six form the second. The first helix presents a bottom end that is formed by the bristle 34 numbered 8, and a top end that is formed by the tooth 36 numbered 2. The second helix has its bottom end formed by the bristle numbered 1, and its top end formed by the bristle 34 numbered 9. Thus, circumferentially, the first succession terminates before the second begins.

Furthermore, in this configuration, the bottom ends 8 and 1 of the two helices extend in two planes that are perpendicular to the axis 20 and that are adjacent to each other. The same applies for the following pairs of bases of each of the helices. This increases the chances of each eyelash meeting two or more fibers while applying mascara. It is common practice for the user to perform application by imparting a turning movement to the brush about its axis 20, e.g. through 120°. Such an angle of rotation suffices to ensure that each eyelash meets at least two fibers while it is in contact with the brush. Furthermore, because of the configuration of this brush, the two fibers may be two bristles 34, a tooth 36 and a bristle 34 in that order, or even a bristle 34 and a tooth 36 in that order.

Furthermore, in the same way as in the embodiment of FIG. 8, the supports 22 are positioned by being offset from one another by a rotation about the axis 20 through one fourth of a turn in a direction opposite to the direction of rotation of the two helices of each support. By means of these opposite directions of rotation, the top end of the helix made up of seven adjacent fibers is adjacent to the bottom end of the helix made up of six fibers on the next support, such that the brush presents zones 44 that have relatively high densities of fibers and zones 42 that have low densities.

Fifth Embodiment

Figure 10:
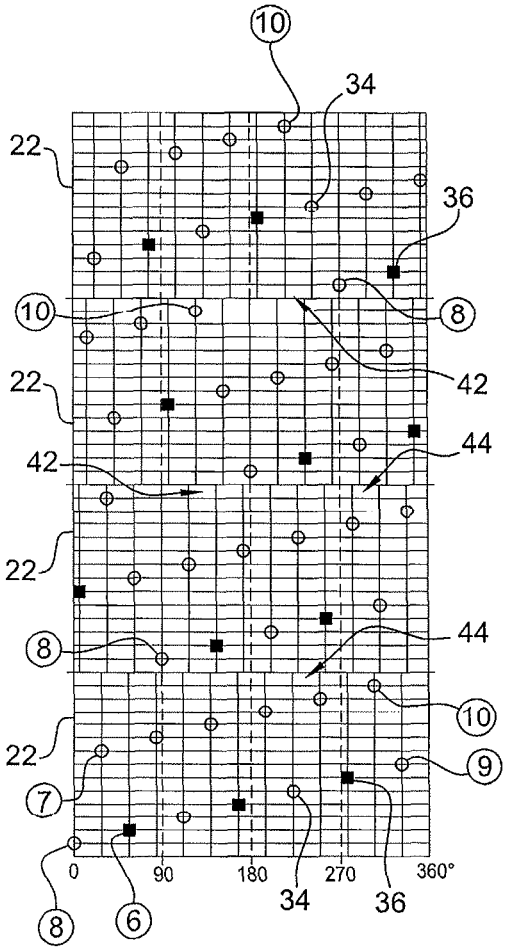

FIG. 10 shows a fifth embodiment that is identical in many ways to the above embodiment. In particular, the two successions are respective helices of the same pitch and of the same direction of rotation, and, in plan view, the support 22 presents a configuration that is identical to the configuration in FIG. 5. But it is no longer seven consecutive fibers about the axis that form the first succession, and the other six that form the second. Starting from the lowest fiber, numbered 8, and going circumferentially around the support, the fibers form parts of the first and second helices in alternation. The first helix is thus made up of the fibers numbered 8 (bottom end of the succession), 6, 4, 2, 13, 11, and 9 (top end of the succession), and the second helix is made up of the fibers numbered 7 (bottom end of the succession), 5, 3, 1, 12, and 10 (top end of the succession). The group of fibers forming the first helix extends below and faces the group of fibers forming the second helix relative to the axial vertical direction. None of the fibers is in alignment with any other fiber along the vertical and/or horizontal directions. In particular, it is possible to make the support 22 by molding with two mold portions that are relatively movable along the axial direction without encountering any problems of undercutting or draft.

Zones 44 of relatively high densities of fibers exist, as do zones 42 of low densities.

Sixth Embodiment

Figure 11:
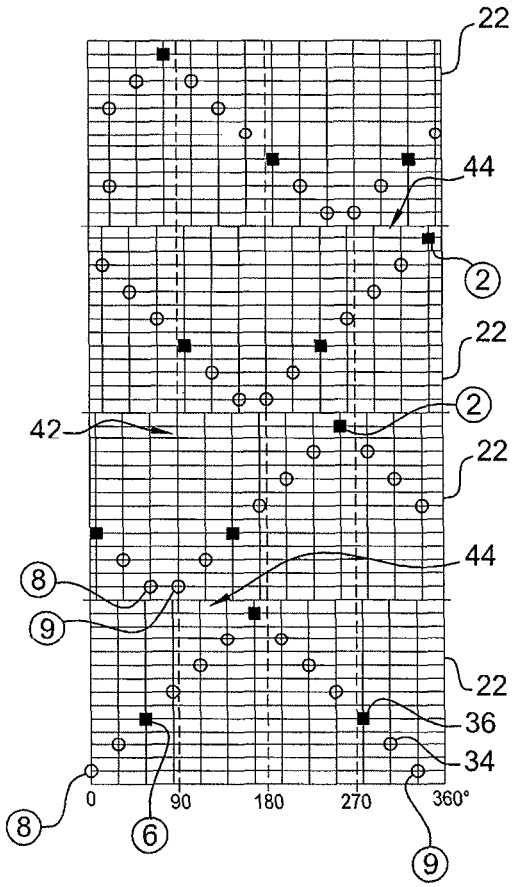

A sixth embodiment is shown in FIG. 11. Each support 22 also presents a configuration that is identical to the configuration in FIG. 5. However, this time, the succession of all of the bases of the support defines a zigzag broken line that is constituted by two consecutive rectilinear segments around the axis. The period of the line does not correspond to the perimeter of the face 30 of the core 24. The line also presents two ends that terminate the succession and that form minimums at the fibers numbered 8 and 9. It passes via a single maximum at the fiber numbered 2. Once again, the supports are offset by one fourth of a turn about the axis. In this embodiment, the contrast between the zones of higher and lower densities 44, 42 is particularly pronounced given that the maximum of each line is adjacent to the minimums of the line of the adjacent support. Apart from the maximum, numbered 2, each fiber of a segment extends over the same horizontal line as a fiber of the other segment. Both of these fibers thus pass through the eyelashes at the same location during a rotary movement of the brush while applying makeup.

Seventh Embodiment

Figure 12:
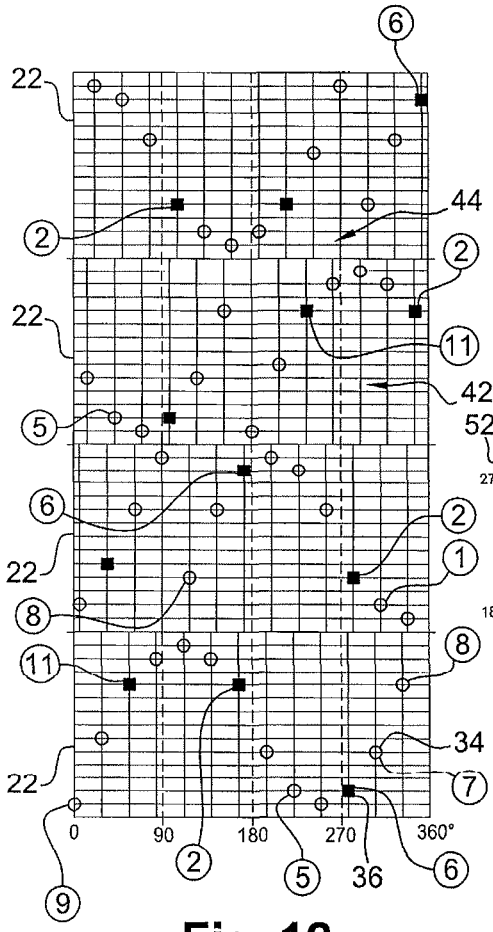

A seventh embodiment is shown in FIG. 12. Each support 22 also presents a configuration that is identical to the configuration in FIG. 5. However, this time, the succession of all of the bases of the support defines a curve that is similar to a sine wave. The period of the sine wave does not correspond to the perimeter of the face 30 of the core 24, the sine wave is incomplete. As in the above successions, it thus presents two ends that terminate the succession. In this configuration, the sine wave covers the range 0° to 270°, these angles being angles of the sine function and not angles measured about the axis 20. The sine wave begins with its minimum that forms its bottom end and that is constituted by the bristle 34 numbered 9. It passes via a maximum and a new minimum formed respectively by the bristles 34 numbered 13 and 5 and it terminates by the end that is constituted by the bristle numbered 8.

Furthermore, the supports are arranged so that each support occupies a configuration that is upsidedown or reversed relative to the support that is contiguous thereto. In other words, each support is the image of the preceding support resulting from a rotation of 180° about an axis that is perpendicular to the axis 20 and that extends in the plane forming the interface between the supports.

Furthermore, the axes of rotation or reversal are not all parallel to one another. FIG. 12 shows the configuration of the four successive supports, distinguishing four quadrants 1, 2, 3, and 4 on each support. The axis of rotation 50 associated with the bottom two supports in the succession is also shown. It passes via the axis of the tooth numbered 5. The axis of rotation 52 serves to pass from the second support to the third support and passes via the axis of the bristle numbered 1. The axis of rotation 54 serves to pass from the third support to the fourth support and passes via the axis of the tooth numbered 5.

The higher density zones 44, situated between the facing sine wave portions, and the lower density zones 42, in the convex regions defined by each sine wave, are once again clearly contrasted.

In addition, as can be seen in FIG. 12, certain planes that are perpendicular to the axis 20 do not intercept any fiber. Other planes each intercept a single fiber, others intercept two fibers, and some others even intercept three fibers. The three fibers may be three bristles 34, or two teeth 36 and a bristle 34. Furthermore, in the embodiment of FIG. 9, the circumferential spacing between the fibers of a single plane is relatively regular and also relatively constant from one plane to another. This is not the situation in this embodiment. Thus, certain fibers of a single plane are relatively close together, while others are very far apart. And when the plane includes three fibers, two are closer to each other than the third. Thus, along its axis, certain segments of the brush are more suitable for loading with composition, while others are more suitable for combing and separating the eyelashes.

Eighth Embodiment

Figure 13:
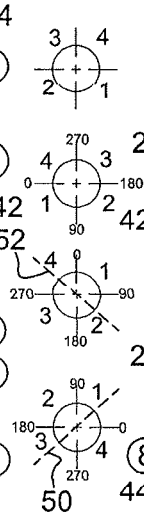
Figure 13:
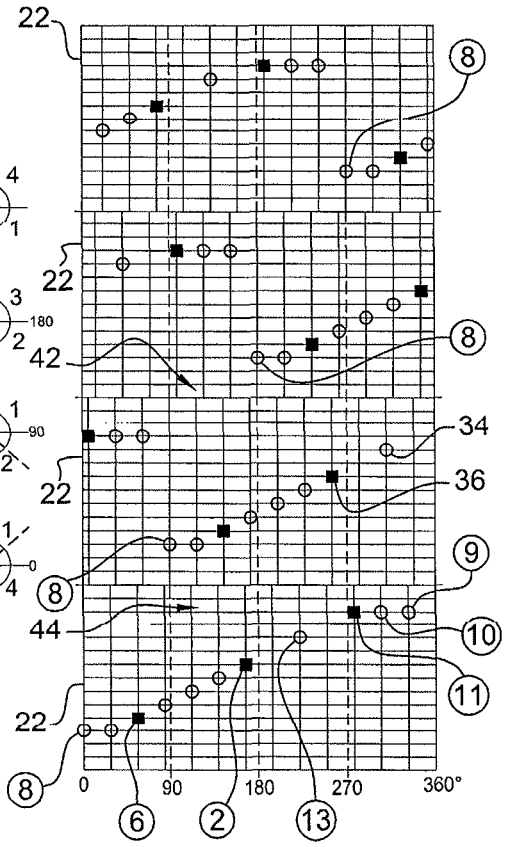

FIG. 13 shows an eighth embodiment. The supports 22 are identical to one another and have the same configuration as FIG. 5 except for two missing fibers, as described below. The supports are isomorphic images of one another resulting from a shift in translation and a rotation through one fourth of a turn, as in FIG. 11. All of the fibers of each support form a curve such as a portion of a sine wave or a broken line. The curve is an increasing curve such that the fibers are situated further and further from the bottom face of the support on going circumferentially around the support. However, the fibers numbered 1 and 12 are missing, their locations being left empty. Only the fibers numbered from 8 to 2 thus form a regular succession, with the fibers 8 and 2 being the ends that terminate the succession. The fibers numbered 13, 11, 10, and 9 are outside the succession. There are still higher density zones 44 and lower density zones 42.

In all of the embodiments, the supports 22 are made by molding them separately from one another.

In the present embodiment, the teeth 36 are stiffer than the bristles 34, such that said bristles are more flexible than the teeth. It is possible to make the bristles out of a material presenting shore hardness on the D scale lying in the range 30 to 45, and the teeth 36 out of a material presenting shore hardness on the D scale lying in the range 30 to 75, e.g. equal to 45. It may suffice to provide a difference of 5 in terms of shore hardness on the D scale between the bristles and the teeth. Alternatively, it is also possible to give them the same hardness.

In this embodiment, the bristles 34 and the teeth 36 are made out of different materials. Specifically, it may be a thermoplastic elastomer polyester such as a material referenced Hytrel, sold by Dupont.

The turning movement that the user gives to the brush while applying makeup causes the eyelashes to be treated sometimes by higher density zones, and sometimes by lower density zones, i.e. sometimes by zones that promote combing, and sometimes by zones that are heavily loaded with composition. Furthermore, the eyelashes sometimes encounter rigid fibers, sometimes flexible fibers.

Given that the shape of a brush and its properties often provide their advantages in full with only certain types of composition formulations, the invention makes it possible to increase the number of configurations possible for the brush, and thus makes it easier to obtain a brush adapted to each type of formula.

The core 24 may have a height along the direction of the axis 20 lying in the range 0.5 millimeters (mm) to 5 mm, e.g. equal to 1 mm. In this configuration, the total diameter of the support is equal to 7.5 mm. It may lie in the range 5 mm to 15 mm, for example.

Naturally, numerous modifications could be applied to the invention without going beyond the ambit thereof.

The arm and the orifice of each support 22 could have a shape that is different from a square in a plane that is perpendicular to the axis. It could be a shape that is polygonal or crenelated. When the supports can occupy different predetermined angular positions about the axis, the number of such positions could be equal to 2, 3, 4, 5 or more. It is even possible for the arm and the orifice of each support 22 to have a shape that is circular in a plane that is perpendicular to the axis, by ensuring they fit together sufficiently tightly to ensure that the support 22 is held stationary on the arm by friction. The angular position of the support on the arm about the axis 20 could then be selected from among infinite possibilities. The same applies for the relative positions of the successive supports 22. The cylindrical outer face 30 of the core does not necessarily have a shape that is circular in a plane that is perpendicular to the axis 20. The shape could be polygonal, e.g. square or elliptical.

Provision could be made for at least one of the projections of the support to extend in a plane that is not perpendicular to the axis 20.

Provision could be made for the bristles 34 to be stiffer than the teeth 36. More generally, the stiffness of a fiber could be determined by selecting its section or by selecting the material from which it is made. In this regard, it should be observed that bristles that are fine and hard provide a good combing action for the eyelashes, while, in comparison, teeth that are thick and flexible load more composition.

Although embodiments are described above in which the number of teeth is equal to three, this number may vary, e.g. it may be equal to 1, 2, 3, 4, or 5. Preferably, the number of teeth provided on each support is less than the number of bristles. The number of bristles lies in the range 7 to 15.

Although not described above, the bristles and the teeth could be of different lengths.

Different supports 22 could be slid over the arm one after the other.

By way of example, the succession formed by the projections could have a paraboloidal, elliptical, or staircase configuration.

Provision could be made to give the bristles and the teeth different colors.

Provision could be made for each support 22 to carry at least three projections that are different from one another in at least one aspect: length, material, hardness, etc. Provision could also be made for all of the projections of the support 22 to be identical to one another.

An applicator could be provided in which, on each support, each projection extends in a plane that is perpendicular to the axis, and at least two of the bases are situated at respective positions along the axis that are different from each other, while ensuring that no group of at least four consecutive bases of the support forms a regular succession about the axis, with two bases of the group constituting two ends that terminate the succession.

What is claimed is:

1. An applicator for applying a composition to eyelashes, the applicator comprising:

a stem and a brush including at least two independent supports following each other along an axis of the stem, each support carrying projections that project radially from respective bases, at least one group of at least four consecutive bases of each support forming a regular succession about the axis, two of the bases of the group constituting two ends that terminate the regular succession, wherein, in the regular succession, at least two bases are at respective positions along the axis that are different from each other such that the projections present offset patterns when forming the regular succession, and each projection of the at least one group extends in a plane that is perpendicular to the axis.

2. An applicator according to claim 1 wherein, in at least one of the groups, the bases form a helix.

3. An applicator according to claim 1, wherein, in at least one of the groups, the bases form a sine wave.

4. An applicator according to claim 1, wherein the two supports or at least two contiguous supports among the supports are images of each other resulting from a shift in translation parallel to the axis.

5. An applicator according to claim 1, wherein the two supports or at least two contiguous supports among the supports are images of each other resulting from the combination of a shift in translation parallel to the axis and a rotation about the axis through an angle that is not a multiple of 360°.

6. An applicator according to claim 2, wherein the two supports or at least two contiguous supports among the supports are images of each other resulting from the combination of a shift in translation parallel to the axis and a rotation about the axis through an angle that is not a multiple of 360°, and wherein rotation takes place through an angle that is less than 180° and in the same direction as the helix.

7. An applicator according to claim 2, wherein the two supports or at least two contiguous supports among the supports are images of each other resulting from the combination of a shift in translation parallel to the axis and a rotation about the axis through an angle that is not a multiple of 360°, and wherein rotation takes place through an angle that is less than 180° and in a direction that is different from the direction of the helix.

8. An applicator according to claim 1, wherein the two supports or at least two contiguous supports among the supports are images of each other resulting from a rotation about an axis that is perpendicular to the axis of the stem.

9. An applicator according to claim 1, wherein, in each support or at least one of the supports, the number of groups forming the regular succession is greater than or equal to two.

10. An applicator according to claim 1, wherein each support is configured so that it does not present any plane of symmetry parallel to the axis, and preferably presents no plane of symmetry.

11. An applicator according to claim 1, wherein each support is configured so that there does not exist any rotation about the axis through an angle that is not a multiple of 360° for which the support is an image of itself resulting from this rotation.

12. An applicator according to claim 1, wherein the supports are mounted on an arm of the stem, and the arm and each support are arranged so as to make it possible to hold the support stationary on the arm in a position selected from among at least two different predetermined relative angular positions about the axis, the number of projections on the support not being divisible by the number of different positions.

13. An applicator according to claim 1, wherein, on each support, the projections are at least four in number, at least two of the projections being identical to each other and different from at least two others of the projections.

14. An applicator according to claim 1, wherein, on each support, at least two of the projections are made out of different respective materials, in particular presenting different harnesses.

15. An assembly for applying a composition to the eyelashes, the assembly comprising: a composition reservoir and an applicator to claim 1.

16. An applicator for applying a composition to eyelashes, the applicator comprising:

a stem; and a brush including at least two independent supports following each other along an axis of the stem and carrying single projections that project radially from respective bases, at least two bases of the single projections being at different horizontal planes, at least one group of at least four consecutive bases of each support forming a regular succession about the axis, two of the bases of the group constituting two ends that terminate the regular succession, wherein, in the regular succession, each projection of the group extends in a plane that is substantially perpendicular to the axis.

* * * * *